US007408533B2

(12) United States Patent
Eom et al.

(10) Patent No.: US 7,408,533 B2
(45) Date of Patent: Aug. 5, 2008

(54) LIGHT EMITTING DISPLAY AND DRIVING METHOD THEREOF

(75) Inventors: Ki-Myeong Eom, Suwon-si (KR); Choon-Yul Oh, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 10 days.

(21) Appl. No.: 11/138,745

(22) Filed: May 25, 2005

(65) Prior Publication Data

US 2005/0285825 A1 Dec. 29, 2005

(30) Foreign Application Priority Data

Jun. 29, 2004 (KR) ..... 10-2004-0049301

(51) Int. Cl.
*G09G 3/30* (2006.01)

(52) U.S. Cl. ..... 345/76; 315/169.3; 345/82

(58) Field of Classification Search ..... 315/161, 315/167, 169.3; 345/55, 76, 77, 78, 80, 82
See application file for complete search history.

(56) References Cited

U.S. PATENT DOCUMENTS

| | | | | |
|---|---|---|---|---|
| 6,989,826 | B2 * | 1/2006 | Kasai | 345/204 |
| 7,202,606 | B2 * | 4/2007 | Eom et al. | 315/169.3 |
| 7,230,592 | B2 | 6/2007 | Sato et al. | |
| 2003/0016190 | A1 | 1/2003 | Kondo | |
| 2004/0017162 | A1 * | 1/2004 | Sato et al. | 315/169.3 |
| 2004/0145547 | A1 * | 7/2004 | Oh | 345/76 |
| 2005/0200575 | A1 * | 9/2005 | Kim et al. | 345/76 |
| 2005/0212446 | A1 * | 9/2005 | Eom | 315/169.3 |

FOREIGN PATENT DOCUMENTS

| | | |
|---|---|---|
| CN | 1496204 A | 5/2004 |
| JP | 2002-514320 | 5/2002 |

(Continued)

OTHER PUBLICATIONS

European Search Report dated Nov. 12, 2007, for corresponding European Patent Application EP 07114036.2, indicating relevance of references in the IDS.

(Continued)

*Primary Examiner*—Thuy Vinh Tran
(74) *Attorney, Agent, or Firm*—Christie, Parker & Hale, LLP

(57) ABSTRACT

A light emitting display includes pixel circuits capable of compensating for the threshold voltages of their driving transistors. Each pixel circuit includes a driving transistor, a capacitor having one end coupled to a gate electrode of the driving transistor, a first switch coupled between the gate electrode of the driving transistor and a first main electrode, which is turned on in response to a first level of a first control signal for diode-coupling the driving transistor, and a second switch turned on in response to a second level of a second control signal to transmit current flowing out of the first main electrode of the driving transistor to a light emitting element. The second switch is turned on when the first switch is turned on for a first period longer than 0.05 μs and shorter than 2.5 μs. The second switch is turned on when the first switch is turned off.

19 Claims, 12 Drawing Sheets

FOREIGN PATENT DOCUMENTS

| | | |
|---|---|---|
| JP | 2003-122301 | 4/2003 |
| JP | 2003-173165 | 6/2003 |
| WO | WO 98/48403 | 10/1998 |

OTHER PUBLICATIONS

Choi, S. et al., *P-II: An Improved Voltage Programmed Pixel Structure for Large Size and High Resolution AM-OLED Displays*; SID 04 Digest, vol. 35, PRT 1, May 25, 2004, pp. 260-263, XP001222795.

Patent Abstracts of Japan, Publication No. 2003-122301, dated Apr. 25, 2003, in the name of Hajime Akimoto et al.

Patent Abstracts of Japan, Publication No. 2003-173165, dated Aug. 20, 2003, in the name of Yoshiaki Aoki.

* cited by examiner

LIGHT EMITTING DISPLAY AND DRIVING METHOD THEREOF

CROSS REFERENCE TO RELATED APPLICATION

This application claims priority to and the benefit of Korean Patent Application No. 10-2004-0049301 filed on Jun. 29, 2004 in the Korean Intellectual Property Office, the entire content of which is incorporated herein by reference.

BACKGROUND OF THE INVENTION (a) Field of the Invention

The present invention relates to a light emitting display, and more particularly to a method of compensating for the variance in the threshold voltage of the driving transistor among the pixel circuits of the light emitting display.

(b) Description of the Related Art

In general, an organic light emitting diode (OLED) display, which is a light emitting display for displaying images using the electroluminescence of an organic material, displays images by driving N×M organic light emission cells arranged in a matrix on a voltage basis or a current basis.

An organic light emission cell, which is also called an organic light emitting diode (OLED) because the cell has diode characteristics, has a multi-layered structure including an anode layer which may be made of indium tin oxide (ITO), an organic thin film layer, and a cathode layer which may be made of metal. The organic thin film also has a multi-layered structure including an emitting layer (EML), an electron transport layer (ETL), and a hole transport layer (HTL). The organic thin film further includes a separate electron injecting layer (EIL) and a separate hole injecting layer (HIL). Therefore in one embodiment, an OLED display panel may be formed by arranging organic light emission cells in an N×M matrix.

Methods for driving the OLED display panel are generally classified as either a passive matrix method or an active matrix method using thin film transistors (TFTs). In the passive matrix method, anodes are perpendicular to cathodes and lines are selected and driven, while in the active matrix method, TFTs are coupled to respective ITO pixel electrodes and are driven by voltages maintained by capacitance of capacitors coupled to gates of the TFTs.

FIG. 1 is an equivalent circuit diagram of a pixel circuit employing a conventional active matrix method.

As shown in FIG. 1, the pixel circuit includes an OLED element (OLED), two transistors including a switching transistor SM and a driving transistor DM, and a capacitor Cst. Each of the two transistors SM and DM is a PMOS transistor.

The switching transistor SM has a gate electrode coupled to a scan line Sn, a source electrode coupled to a data line Dm, and a drain electrode coupled to one end of the capacitor Cst and a gate electrode of the driving transistor DM. The other end of the capacitor Cst is coupled to an operation voltage VDD. The driving transistor DM has a source electrode coupled to the operation voltage VDD and a drain electrode coupled to a pixel electrode of the OLED element (OLED). The OLED element (OLED) has a cathode coupled to a reference voltage Vss and emits light under application of current through the driving transistor DM. In this embodiment, the reference voltage Vss coupled to the cathode of the OLED element (OLED) is a voltage lower than the operation voltage VDD. For example, the reference voltage Vss may be a ground voltage.

In operation of the pixel circuit as configured above, when a select signal is applied to the scan line Sn and the switching transistor SM is then turned on, a data voltage is applied to the one end of the capacitor Cst and the gate electrode of the driving transistor DM. Accordingly, a gate-source voltage $V_{GS}$ of the driving transistor DM is maintained for a certain time by the capacitor Cst. The driving transistor DM applies current $I_{OLED}$ corresponding to the gate-source voltage $V_{GS}$ to the pixel electrode of the OLED element (OLED), causing the OLED element (OLED) to emit light. At this time, the current $I_{OLED}$ flowing through the OLED element (OLED) is expressed by the following Equation 1.

$$I_{OLED} = \frac{\beta}{2}(V_{GS} - V_{TH})^2 = \frac{\beta}{2}(V_{DD} - V_{DATA} - |V_{TH}|)^2 \quad \text{[Equation 1]}$$

As can be seen from Equation 1, when a high data voltage $V_{DATA}$ is applied to the gate electrode of the driving transistor DM, the gate-source voltage $V_{GS}$ of the driving transistor DM is lowered at which point a small amount of current $I_{OLED}$ is applied to the pixel electrode resulting in a low light emission from the OLED element (OLED), and hence low gray scales of the OLED display panel. In contrast, when a low data voltage $V_{DATA}$ is applied to the gate electrode of the driving transistor DM, the gate-source voltage $V_{GS}$ of the driving transistor DM is raised at which point a large amount of current $I_{OLED}$ is applied to the pixel electrode, resulting in a high light emission from the OLED element (OLED), and hence high gray scales of the OLED display panel. In this way, a level of the data voltage applied to the pixel circuit may be determined based on an image data signal to be displayed.

However, as can be seen from Equation 1, in the pixel circuit as mentioned above, the current $I_{OLED}$ depends on a threshold voltage Vth of the driving transistor DM. Therefore, a difficulty may arise in accurately displaying images due to the different threshold voltages of the driving transistor DM for different pixels.

SUMMARY OF THE INVENTION

In one exemplary embodiment of the present invention, a light emitting display includes pixel circuits which are capable of compensating for threshold voltages of driving transistors.

In an exemplary embodiment of the present invention, a light emitting display includes a plurality of scan lines for transmitting a select signal, a plurality of data lines for transmitting a data voltage, and a plurality of pixel circuits. Each of the plurality of pixel circuits is coupled to at least one of the plurality of scan lines and at least one of the plurality of data lines. In at least one of the pixel circuits, a first capacitor has one end coupled to a gate electrode of a first transistor. A first switch is coupled between the gate electrode of the first transistor and a first main electrode of the first transistor, and the first switch is turned on in response to a first level of a first control signal, thereby diode-coupling the first transistor. A light emitting element emits light corresponding to a current flowing out of the first main electrode of the first transistor, and a second switch is turned on in response to a second level of a second control signal for transmitting the current flowing out of the first main electrode of the first transistor. The second switch is turned on during a first period when the first switch is turned on. The second switch is turned off after the first period, and the second switch is turned on when the first switch is turned off.

The first period may be longer than 0.05 μs.

The first period may be shorter than 2.5 μs.

The at least one of the pixel circuits may further include a third switch, a second capacitor and a fourth switch. The third switch may be turned on in response to a third level of a select signal for transmitting the data signal to an other end of the first capacitor. The second capacitor may have one end coupled to a first power line and an other end coupled to the other end of the first capacitor. The fourth switch may be turned on in response to a fourth level of a third control signal to be coupled to the second capacitor in parallel.

The first control signal may be a previous select signal applied prior to the select signal, and the first level may be equal to the third level.

The third control signal may be equal to the first control signal, and the fourth level may be equal to the first level.

The second switch may be turned on when the first switch, the third switch and the fourth switch are turned off.

The select signal having the third level may be applied after the second period during which the previous select signal is applied.

The at least one of the pixel circuits may further include a third switch being turned on in response to a third level of the select signal for transmitting the data signal to a second main electrode of the first transistor, and a fourth switch being turned on in response to a fifth level of a fourth control signal for transmitting the data signal transmitted through the third switch to an other end of the first capacitor.

The first control signal and the fourth control signal may be a select signal.

The at least one of the pixel circuits may further include a third switch being turned on in response to a third level of a select signal for transmitting the data signal to the other end of the first capacitor, and a second capacitor coupled at one end to a first power line and at another end to an other end of the first capacitor.

In another exemplary embodiment of the present invention, a method is provided for driving a light emitting display including a capacitor having a first electrode coupled to a first power source, a driving transistor having a gate electrode coupled to a second electrode of the capacitor, and a light emitting element for emitting light based on a current applied from the driving transistor. The method includes transmitting the current from the driving transistor to the light emitting element when the driving transistor is in a diode-coupled state, coupling the light emitting element to the driving transistor, and transmitting the current from the driving transistor to the light emitting element when the first power source is coupled to a source electrode of the driving transistor. The current is transmitted from the driving transistor to the light emitting element when the driving transistor is diode-coupled for a time longer than 0.05 μs.

The current may be transmitted from the driving transistor to the light emitting element when the driving transistor is diode-coupled for a time shorter than 2.5 μs.

The method may further include applying a data voltage to the capacitor.

Coupling the light emitting element to the driving transistor may further include applying a data voltage to the capacitor.

BRIEF DESCRIPTION OF THE DRAWINGS

The accompanying drawings illustrate exemplary embodiments of the present invention, and, together with the description, serve to explain the principles of the invention.

DETAILED DESCRIPTION

Figure 1:
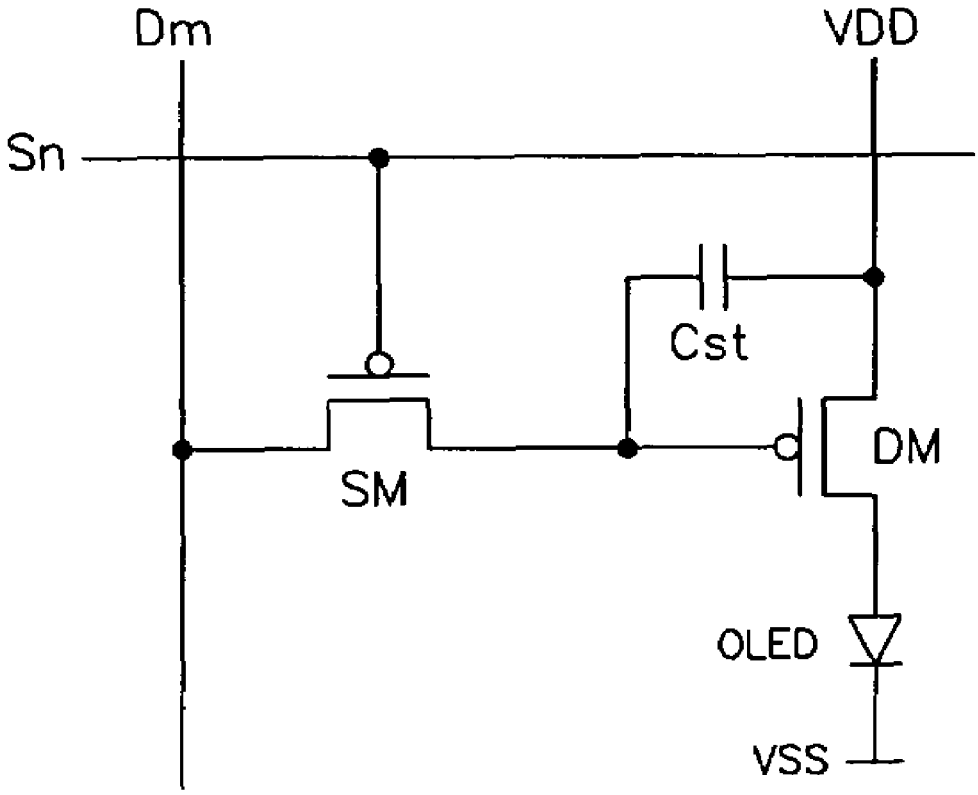
FIG.1 (Prior Art)
FIG. 1 is an equivalent circuit diagram of a pixel circuit employing a conventional active matrix method.

In the following detailed description, only certain exemplary embodiments of the present invention are shown and described, simply by way of illustration. As those skilled in the art would realize, the described embodiments may be modified in various different ways, all without departing from the spirit or scope of the present invention.

Accordingly, the drawings and description are to be regarded as illustrative in nature, and not restrictive. There may be parts shown in the drawings, or parts not shown in the drawings, that are not discussed in the specification as they are not essential to a complete understanding of the invention. Like reference numerals designate like elements. The phrases such as "one thing is coupled to another" may denote either "a first one is directly coupled to a second one" or "the first one is electrically coupled to the second one with a third one provided between".

Figure 2:
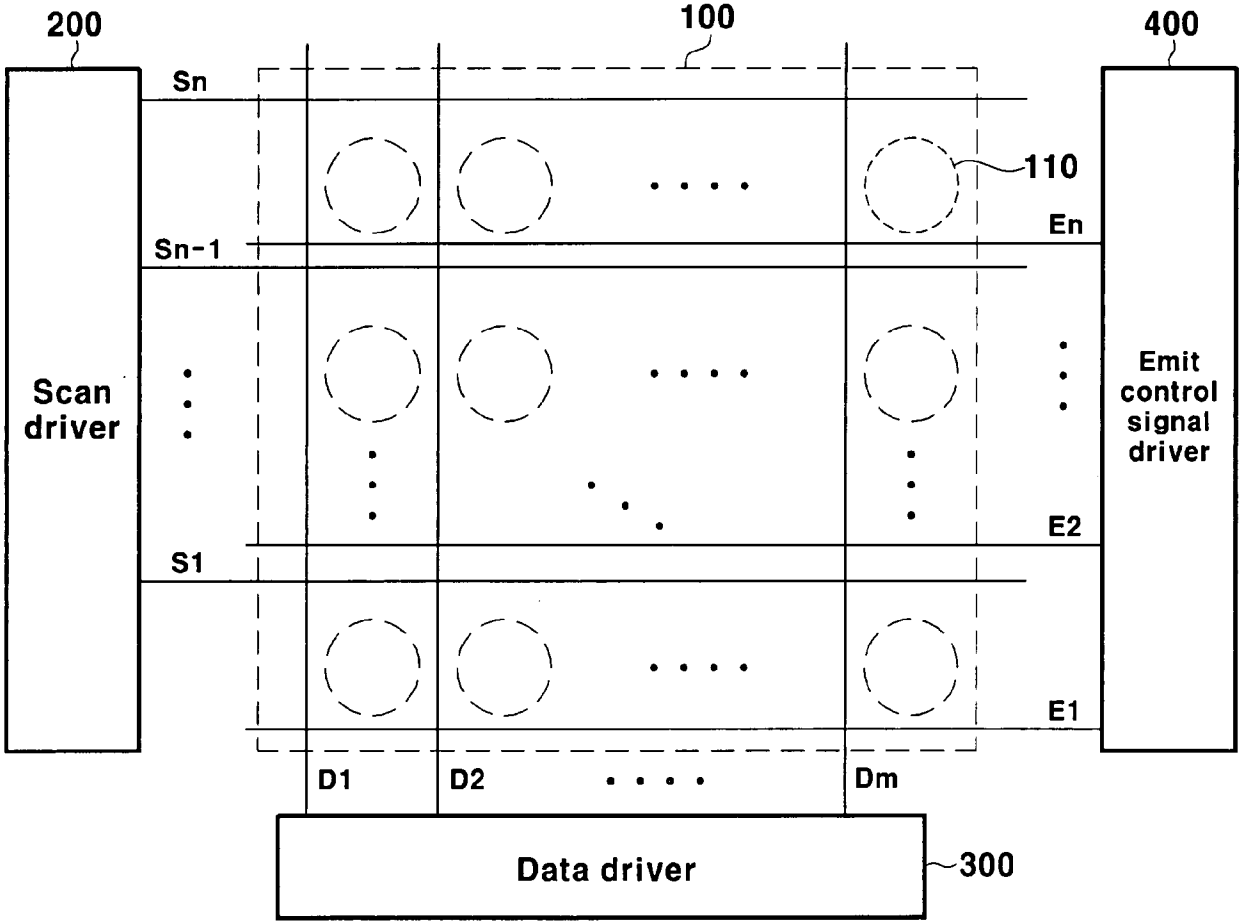
FIG. 2 is a schematic view illustrating an OLED display according to one exemplary embodiment of the present invention.

FIG. 2 is a schematic view illustrating an OLED display according to one exemplary embodiment of the present invention.

As shown in FIG. 2, the OLED display includes an OLED display panel 100, a scan driver 200, a data driver 300, and an emit control signal driver 400.

The OLED display panel 100 in turn includes a plurality of data lines D1 to Dm extending in a column direction, a plurality of scan lines S1 to Sn extending in a row direction, and a plurality of pixel circuits 110. The data lines D1 to Dm transmit data signals representing image signals to the pixel circuits 110, and the scan lines S1 to Sn transmit select signals to the pixel circuits 110.

In the embodiment shown in FIG. 2, the scan driver 200 applies the select signals to the scan lines S1 to Sn sequentially, and the data driver 300 applies the data signals to the data lines D1 to Dm. Further, the emit control signal driver applies emit control signals to the emit control lines E1 to En.

Here, the scan driver 200, the data driver 300 and/or the emit control signal driver 400 may be coupled to the display panel 100, or may be mounted in the form of a chip on a tape carrier package (TCP), a flexible printed circuit (FPC), or a film conductively bonded to the display panel 100. Alternatively, the scan driver 200, the data driver 300 and/or the emit control signal driver 400 may be directly mounted on either a glass substrate of the display panel 100 or the driving circuit, or may be replaced with a driving circuit formed in the same layer as the scan lines, the data lines and the thin film transistors.

Figure 3:
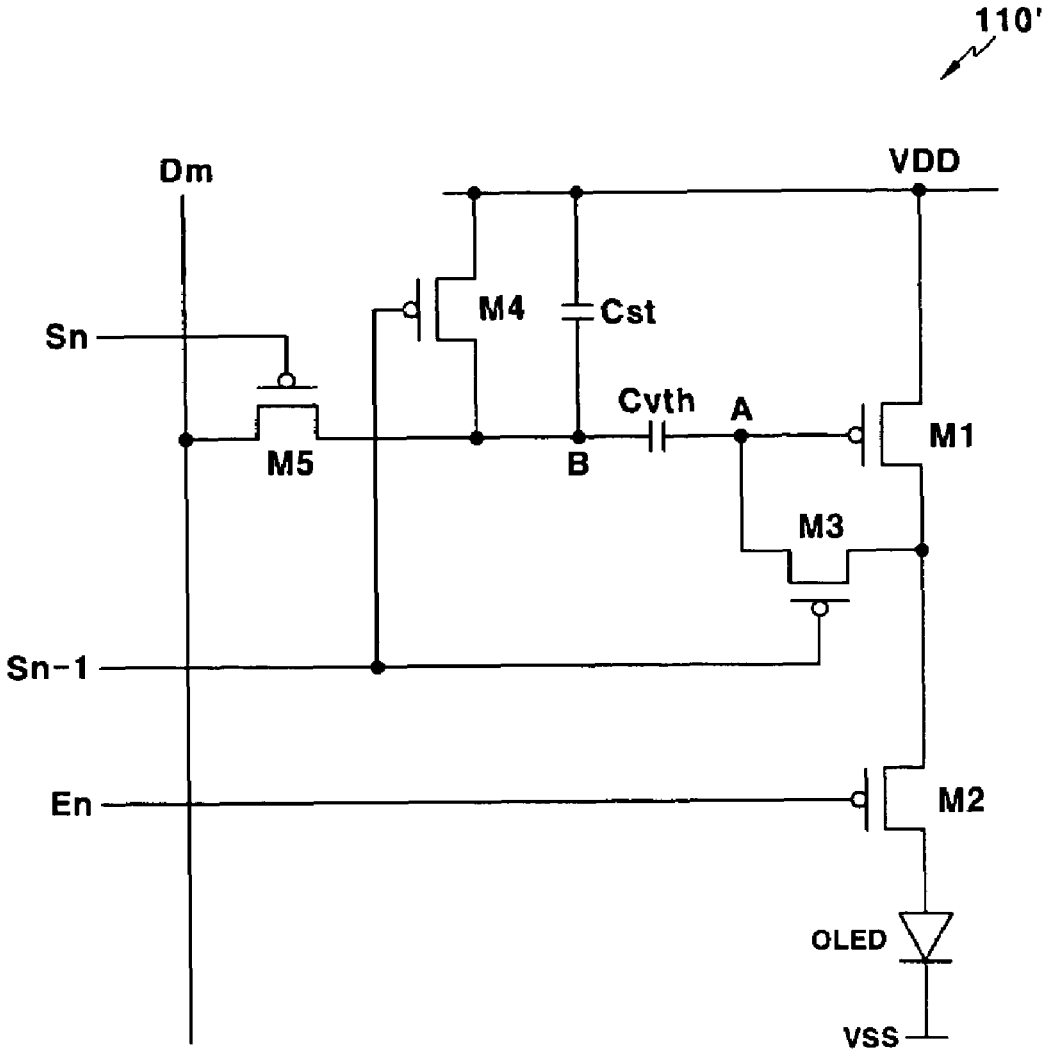
FIG. 3 is an equivalent circuit diagram of a pixel circuit of an OLED display according to exemplary embodiments of the present invention.

FIG. 3 is an equivalent circuit diagram of a pixel circuit 110' of an OLED display according to exemplary embodiments of the present invention. The pixel circuit 110', for example, can be used as the pixel circuit 110 of FIG. 2.

In the following description of the embodiment discussed herein, a scan line to which a current select signal Sn is applied is called a current scan line Sn, and a scan line to which a previous select signal Sn-1 prior to the application of the current selection Sn is applied is called a previous scan line Sn-1. Therefore, a select signal is denoted by the reference numeral corresponding to a scan line to which the select signal is applied.

As shown in FIG. 3, the pixel circuit 110' includes transistors M1, M2, M3, M4 and M5, capacitors Cst and Cvth, and an OLED element (OLED). In the embodiment of the pixel circuit 110' shown, all transistors are shown as a p-channel transistor.

The transistor M5, which in this embodiment is a switching transistor for transmitting a data voltage applied through the data line Dm, has a gate electrode coupled to the current scan line Sn and a source electrode coupled to the data line Dm. Accordingly, the transistor M5 transmits the data signal transmitted from the data line Dm to one end or electrode B of the capacitor Cvth in response to the current select signal Sn. The capacitor Cst has one end coupled to an operation voltage VDD and the other end coupled to a drain electrode of the transistor M5, and stores a voltage corresponding to a voltage of the data signal transmitted through the transistor M5. The transistor M4 has a gate electrode coupled to the previous scan line Sn-1, a source electrode coupled to the operation voltage VDD, and a drain electrode coupled to the drain electrode of the transistor M5, and is coupled in parallel with the capacitor Cst. Accordingly, the transistor M4 supplies the operation voltage VDD to the end B of the capacitor Cvth in response to the select signal from the previous scan line Sn-1. The transistor M1, which is a driving transistor for driving the OLED element (OLED), has a source electrode coupled to the operation voltage VDD and a drain electrode coupled to a source electrode of the transistor M3. The transistor M3 has a gate electrode coupled to the previous scan line Sn-1 and diode-couples the transistor M1 in response to the previous select signal Sn-1 having a low level. The capacitor Cvth has the other end or electrode A coupled to a gate electrode of the transistor M1 and the electrode B coupled to the one end of the capacitor Cst. The transistor M2 is coupled between the drain electrode of the transistor M1 and an anode of the OLED element (OLED) from which the transistor M2 disconnects the drain electrode of the transistor M1 in response to an emit control signal En. Accordingly, the OLED element (OLED) emits light corresponding to current inputted thereto from the transistor M1 through the transistor M2.

Figure 4:
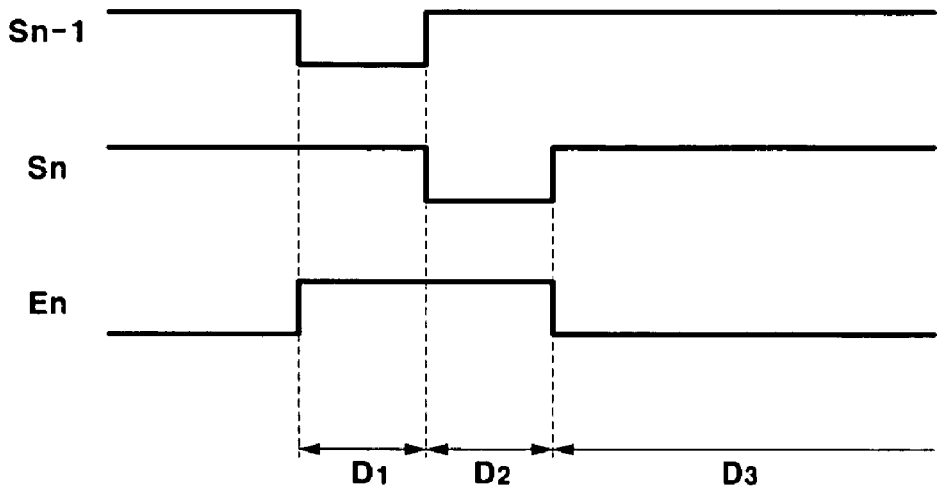
FIG. 4 is a timing diagram of signals applied to the pixel circuit of FIG. 3 according to a first exemplary embodiment of the present invention.

FIG. 4 is a timing diagram of signals applied to the pixel circuit 110' of FIG. 3 according to a first exemplary embodiment of the present invention.

First, a period D1 is an interval during which the previous select signal Sn-1 has a low level and the current select signal Sn has a high level. During the period D1, the transistor M3 is turned on and the transistor M1 is diode-coupled. Accordingly, a gate-source voltage of the transistor M1 is changed until it becomes a threshold voltage Vth of the transistor M1. At this time, since the source electrode of the transistor M1 is coupled to the operation voltage VDD, a voltage applied to the gate electrode of the transistor M1 (also the electrode A of the capacitor Vth) becomes the sum of the operation voltage VDD and the threshold voltage Vth. Also, the transistor M4 is turned on and the operation voltage VDD is applied to the electrode B of the capacitor Cvth. Accordingly, a voltage $V_{Cvth}$ charged at the capacitor Cvth is expressed by the following Equation 2.

$$V_{Cvth}=V_{CvthA}-V_{CvthB}=(VDD+Vth)-VDD=Vth \quad \text{[Equation 2]}$$

In Equation 2, $V_{Cvth}$ represents a voltage charged at the capacitor Cvth, $V_{CvthA}$ represents a voltage applied to the electrode A of the capacitor Cvth, and $V_{CvthB}$ represents a voltage applied to the electrode B of the capacitor Cvth. During this period D1, an emit control signal En has a high level and the transistor M2 is turned off. Accordingly, current is prevented from flowing from the transistor M1 through the OLED element (OLED).

Next, a period D2 is an interval during which the current select signal Sn having a low level is applied and data is programmed. During the period D2, the transistor M5 is turned on and a data voltage Vdata is applied to the electrode B. Also, since a voltage corresponding to the threshold voltage of the transistor M1 is charged at the capacitor Cvth, a voltage corresponding to the sum of the data voltage Vdata and the threshold voltage Vth of the transistor M1 is applied to the gate electrode of the transistor M1. A gate-source voltage Vgs of the transistor M1 is expressed by the following Equation 3. At this time, the emit control signal En has a high level and the transistor M2 is turned off. Accordingly, current is prevented from flowing from the transistor M1 through the OLED element (OLED).

$$Vgs=(Vdata+Vth)-VDD \quad \text{[Equation 3 ]}$$

Next, a period D3 is an interval during which the emit control signal En having a low level is applied. In response to the emit control signal En having a low level, the transistor M2 is turned on to supply current $I_{OLED}$ corresponding to the gate-source voltage Vgs of the transistor M1 to the OLED element (OLED), causing the OLED element (OLED) to emit light. The current $I_{OLED}$ is expressed by the following Equation 4.

$$\begin{aligned} I_{OLED} &= \frac{\beta}{2}(Vgs - Vth)^2 \\ &= \frac{\beta}{2}((Vdata + Vth - VDD) - Vth)^2 \\ &= \frac{\beta}{2}(VDD - Vdata)^2 \end{aligned} \quad \text{[Equation 4]}$$

In the context of this equation, the current $I_{OLED}$ represents the current flowing through the OLED element (OLED), Vgs represents the source-gate voltage of the transistor M1, Vth represents the threshold voltage of the transistor M1, Vdata represents the data voltage, and β represents a constant. As can be seen from Equation 4, since the current $I_{OLED}$ is determined based on the data voltage Vdata and the operation voltage VDD regardless of the threshold voltage of the driving transistor, the display panel can be stably driven.

However, according to the driving method of the first exemplary embodiment shown in FIG. 4, a voltage stored at the capacitor Cvth is varied according to a previous driving, and detection of the threshold voltage Vth of the driving transistor M1 may be unstable depending on the state of the capacitor Cvth. As such, it is desirable to initialize the gate electrode of the transistor M1 (i.e., the capacitor Cvth) before the data voltage Vdata is applied.

Figure 5:
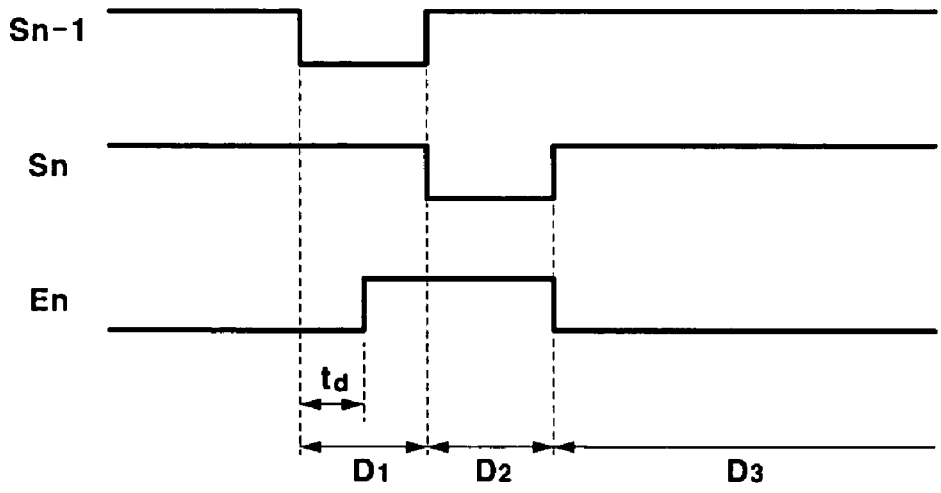
FIG. 5 is a timing diagram of signals applied to the pixel circuit shown in FIG. 3 according to a second exemplary embodiment of the present invention.
Figure 6:
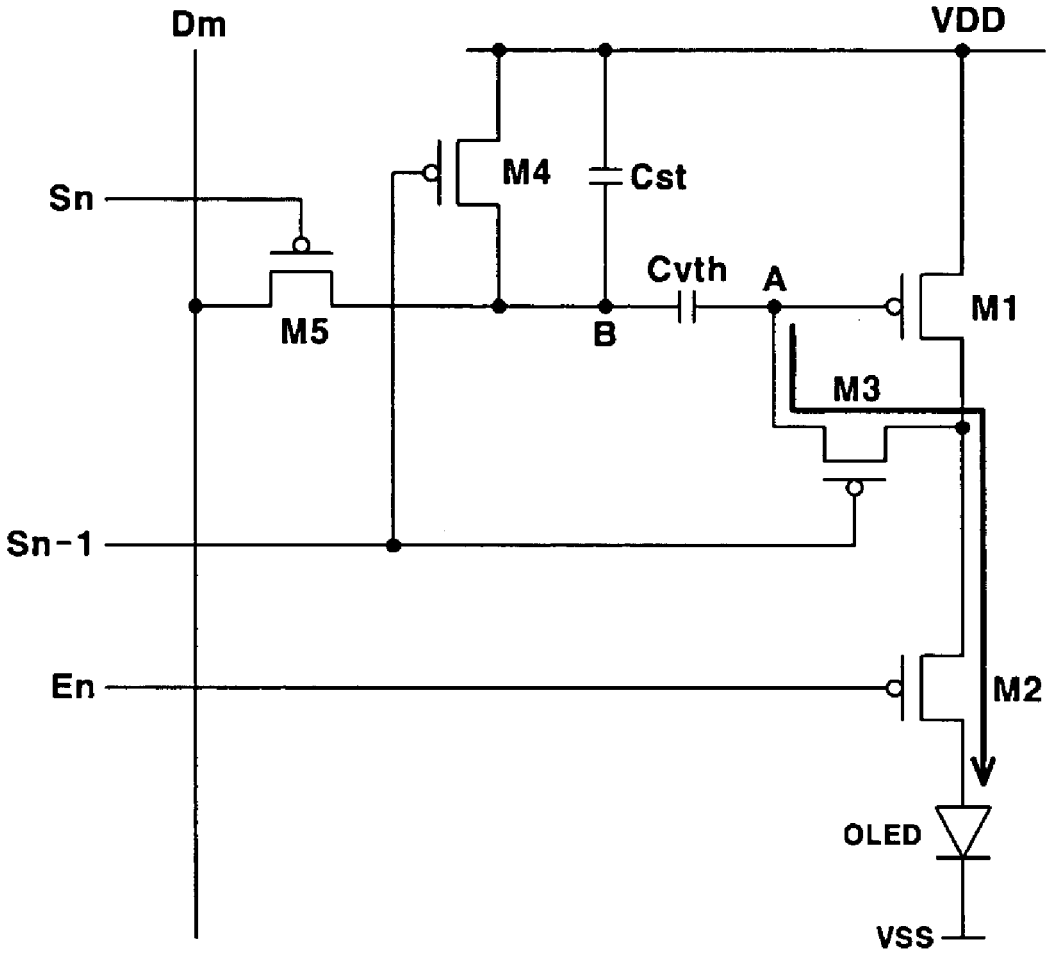
FIG. 6 is a diagram showing a current path formed for a time period td in FIG. 5.

FIG. 5 is a timing diagram of signals applied to the pixel circuit 110', shown in FIG. 3, according to a second exemplary embodiment of the present invention, and FIG. 6 is a diagram showing a current path formed for a time period td in FIG. 5.

The second exemplary embodiment is different from the first exemplary embodiment shown in FIG. 4 in that the emit control signal En having a low level is applied for a certain time period td of the period D1.

More specifically, for the certain time period td of the period D1 shown in FIG. 5, the previous select signal Sn-1 having a low level and the current select signal Sn having a high level are applied concurrently with application of the emit control signal En having a low level. In other words, for the certain time period td, the transistor M3 is turned on and the transistor M1 is diode-coupled, and concurrently, the emit control signal En having the low level is applied to the gate electrode of the transistor M2, thereby turning on the transistor M2. As the transistors M3 and M2 are turned on, an initialization current path from the gate electrode of the transistor M1 (i.e., the electrode A of the capacitor Cvth) through the transistor M3, to the cathode Vss of the OLED element (OLED) is formed, as indicated by a thick line in FIG. 6. The electrode A of the capacitor Cvth is initialized to a voltage (which may be a voltage of Vss+|Vth(OLED)| through the initialization current path. After the certain time period td elapses, the emit control signal En goes to a high level and the transistor M2 is turned off to prevent the current from flowing from the transistor M1 through the OLED element (OLED).

As such, the capacitor Cvth may be initialized by applying the emit control signal En having the low level for the certain time period td while the previous select signal Sn-1 has the low level in order to form the initialization current path. Accordingly, when the current select signal Sn having the low level is applied and the data voltage is applied, the data voltage can be more stably stored at the capacitor Cvth.

However, the certain time period td should be longer than the time required to apply the voltage already stored at the capacitor Cvth to the OLED element (OLED) through the transistors M3 and M2 in order to initialize the capacitor Cvth. In one embodiment, the minimal time for initialization of the capacitor Cvth is 0.05 μs. Accordingly, the certain time period td must be longer than 0.05 μs. If the certain time period td is shorter than 0.05 μs, the uniformity of image quality deteriorates since the threshold voltage Vth of the transistor M1 may not be compensated for.

On the other hand, if the certain time period td is too long, a leakage current may instantaneously flow into the OLED element (OLED) through the transistor M2 resulting in an erroneous light emission. For example, although a data voltage for displaying black color is applied, a contrast ratio may be deteriorated due to the erroneous light emission. Accordingly, the certain time period td should be a time for which the erroneous light emission due to the leakage current flowing into the OLED element (OLED) does not occur. The following Table 1 shows the relationship between the time period td and brightness when the duration of the low level of the previous and current select signals is 60 μs.

TABLE 1

| | td(μs) | | | | | | | | | | | | |
|---|---|---|---|---|---|---|---|---|---|---|---|---|---|
| | 0 | 0.25 | 0.5 | 0.75 | 1 | 1.25 | 1.5 | 1.75 | 2 | 2.25 | 2.5 | 2.75 | 3 |
| Brightness | 0.01 | 0.01 | 0.01 | 0.02 | 0.05 | 0.15 | 0.28 | 0.52 | 1.12 | 1.9 | 3.22 | 4.73 | 6.93 |

On the other hand, if the brightness is more than about 3 cd/m$^2$, it is determined that black color cannot be sufficiently expressed. Accordingly, if the time period td is shorter than the time period for which the brightness is about 3 cd/m$^2$, that is, 2.5 μs, the brightness can be maintained enough to express the black color. As such, the threshold voltage Vth can be compensated for and a range of the time period td for which the capacitor can be initialized can be determined as the following Equation 5.

$$0.05\ \mu s < td < 2.5\ \mu s \qquad \text{[Equation 5]}$$

For example, if the contrast ration is 100:1, black brightness may be 1.5 cd/m$^2$ and white brightness may be 150 cd/m$^2$. In this case, the certain time period td may be 0.28 μs.

Figure 7:
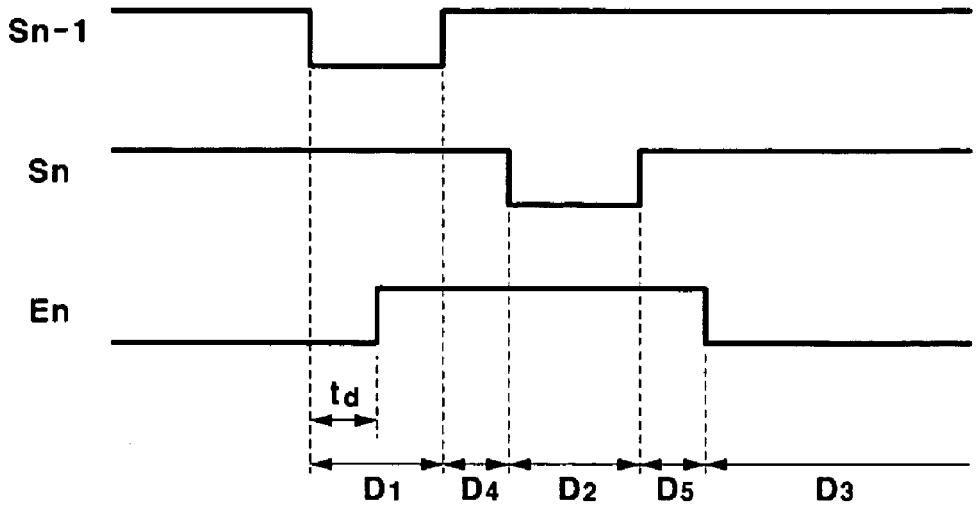
FIG. 7 is a timing diagram of signals applied to the pixel circuit of FIG. 3 according to a third exemplary embodiment of the present invention.

FIG. 7 is another timing diagram of signals applied to the pixel circuit 110' according to a third exemplary embodiment of the present invention.

A driving method of the third exemplary embodiment shown in FIG. 7 is different from the driving method of the second exemplary embodiment shown in FIG. 5 in that a blanking period D4 is provided between the period D1 and a period D2 and a blanking period D5 is provided between the period D2 and a period D3. The blanking periods D4 and D5 serve to prevent an erroneous operation due to a signal transmission delay.

Next, a pixel circuit according to a fourth exemplary embodiment of the present invention and operation thereof will be described in detail with reference to FIGS. 8 and 9.

Figure 8:
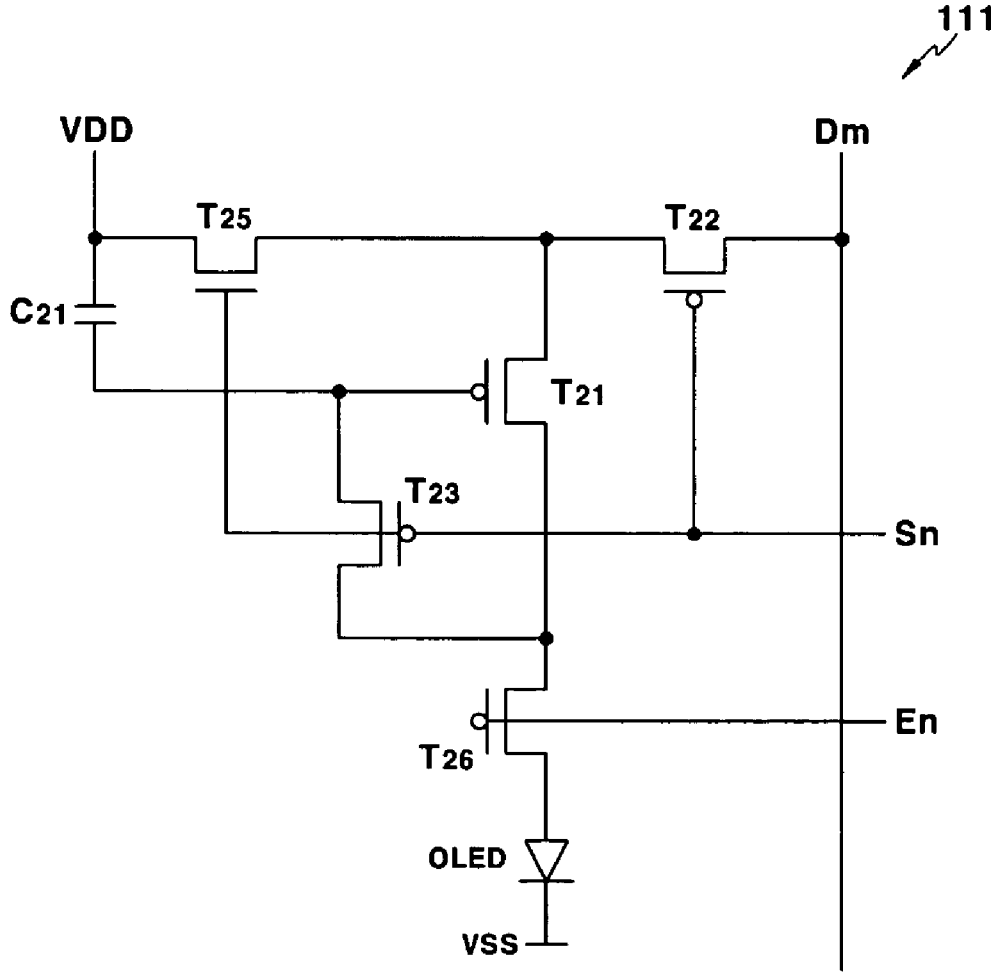
FIG. 8 is an equivalent circuit diagram of a pixel circuit of an OLED display according to a fourth exemplary embodiment of the present invention.

FIG. 8 is an equivalent circuit diagram of a pixel circuit 111 of an OLED display according to a fourth exemplary embodiment of the present invention. The pixel circuit 111, for example, can be used as the pixel circuit 110 of FIG. 2.

Referring to FIG. 8, the pixel circuit 111 includes five transistors T21, T22, T23, T25 and T26, a capacitor C21, and an OLED element (OLED). Here, the transistors T21, T22, T23 and T26 are p-channel transistors and the transistor T25 is an n-channel transistor.

In the embodiment shown, the pixel circuit 111 includes the OLED element (OLED) for emitting light corresponding to an applied driving current, the switching transistor T22 for transmitting a data signal $V_{DATA}$ applied to a corresponding data line Dm in response to the current select signal Sn, the driving transistor T21 for supplying a current $I_{OLED}$ corresponding to the data signal $V_{DATA}$ to the OLED element (OLED), the threshold voltage compensation transistor T23 for compensating for a threshold voltage of the driving transistor T21, and the capacitor C21 for storing a voltage corresponding to the data signal $V_{DATA}$ applied to a gate electrode of the driving transistor T21. In addition, the pixel circuit 111 includes the switching transistor T25 for transmitting an operation voltage VDD to a source electrode of the driving transistor T21 in response to the current select signal Sn, and the switching transistor T26 for transmitting the current $I_{QLED}$ outputted through a drain electrode of the driving transistor T21 to the OLED element (OLED) in response to an emit control signal En.

More specifically, the switching transistor T22 has a gate electrode coupled to the scan line Sn, a source electrode coupled to the data line Dm, and a drain electrode coupled to the source electrode of the driving transistor T21. The driving transistor T21 has the gate electrode coupled to one end of the capacitor C21 and a drain electrode coupled to one end of the OLED element (OLED) through the switching transistor T26. The threshold voltage compensation transistor T23 has a drain electrode and a source electrode coupled respectively to the gate electrode and the drain electrode of the driving transistor T21, and a gate electrode to which the current select signal Sn is applied. The other end of the capacitor C21 is coupled to the operation voltage VDD from a corresponding power line. In addition, the switching transistor T25 has a gate electrode to which the current select signal Sn is applied, a source electrode coupled to the operation voltage VDD, and a drain electrode coupled to the source electrode of the driving transistor T21. The switching transistor T26 has a gate electrode to which an emit control signal En is applied, a source electrode coupled to the drain electrode of the driving transistor T21, and a drain electrode coupled to an anode of the OLED element (OLED). An operation voltage VSS lower than the operation voltage VDD is applied to a cathode of the OLED element (OLED), which operation voltage VSS may be either a negative voltage or a ground voltage.

Now, the operation of the pixel circuit 111 of FIG. 8 as configured above will be described with reference to FIGS. 9 and 10A to 10C.

Figure 9:
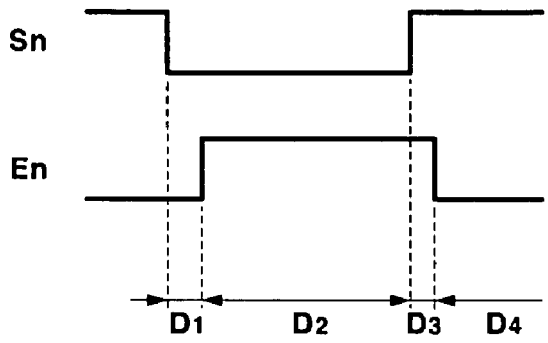
FIG. 9 is a waveform diagram illustrating signals applied to the pixel circuit of FIG. 8 according to the fourth exemplary embodiment.
Figure 10A:
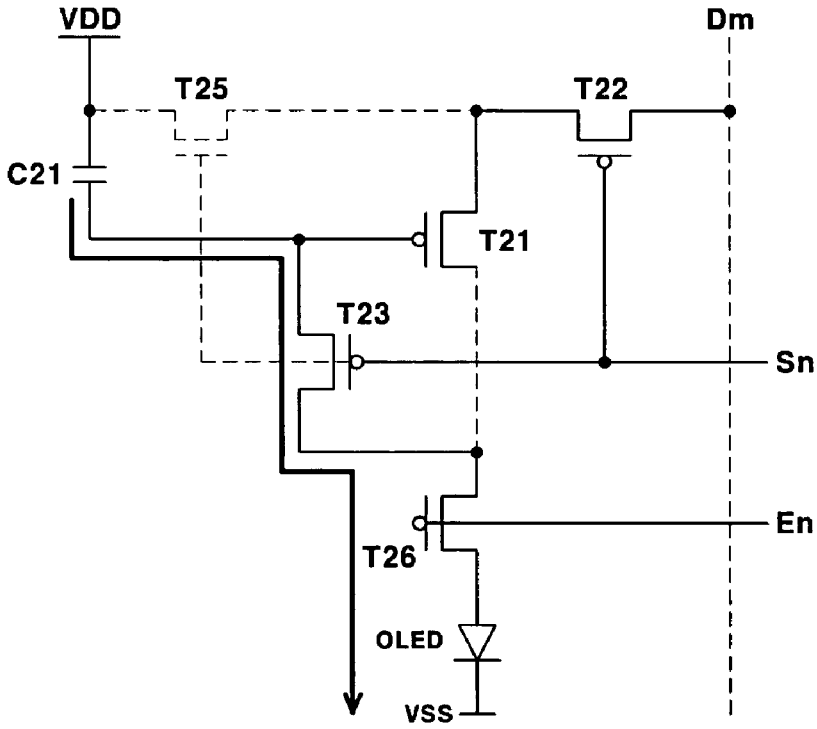
FIGS. 10A, 10B and 10C are diagrams showing a current path formed for each period in FIG. 9.
Figure 10B:
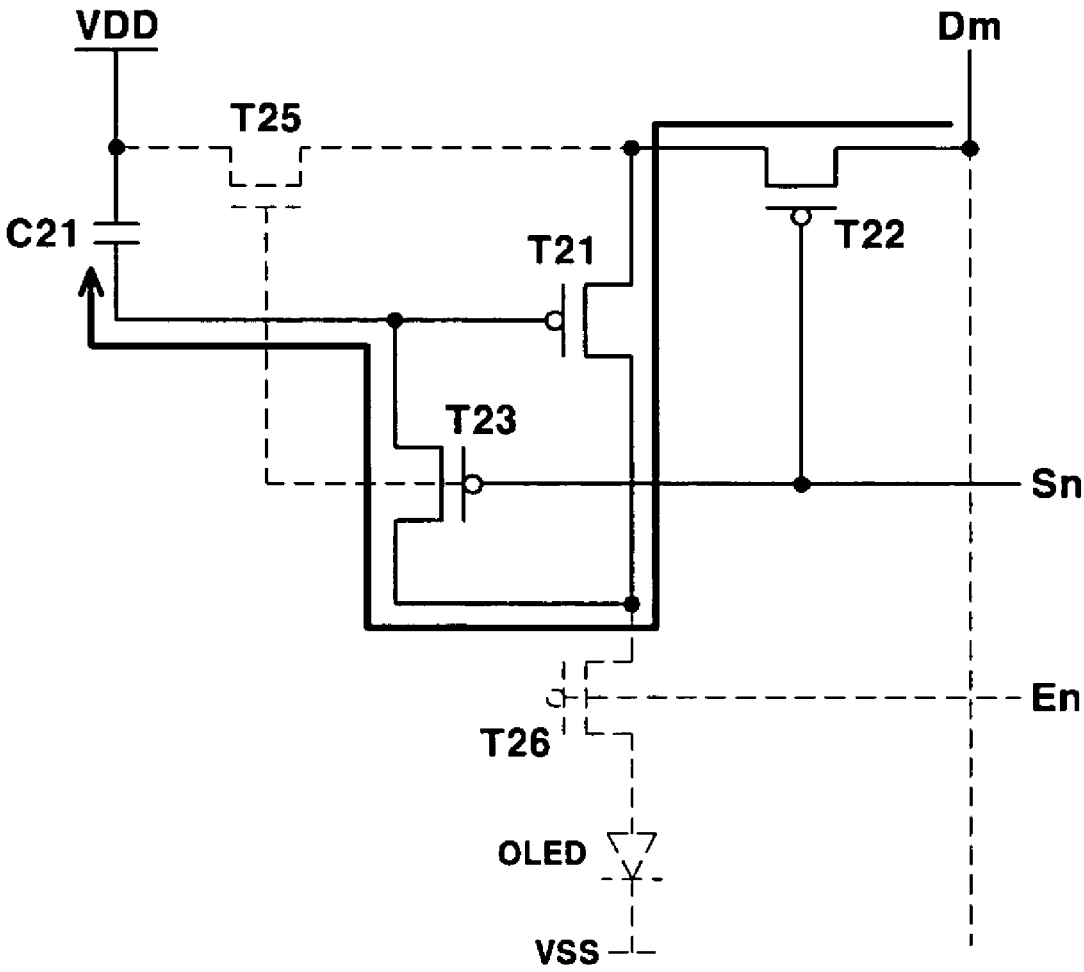
Figure 10C:
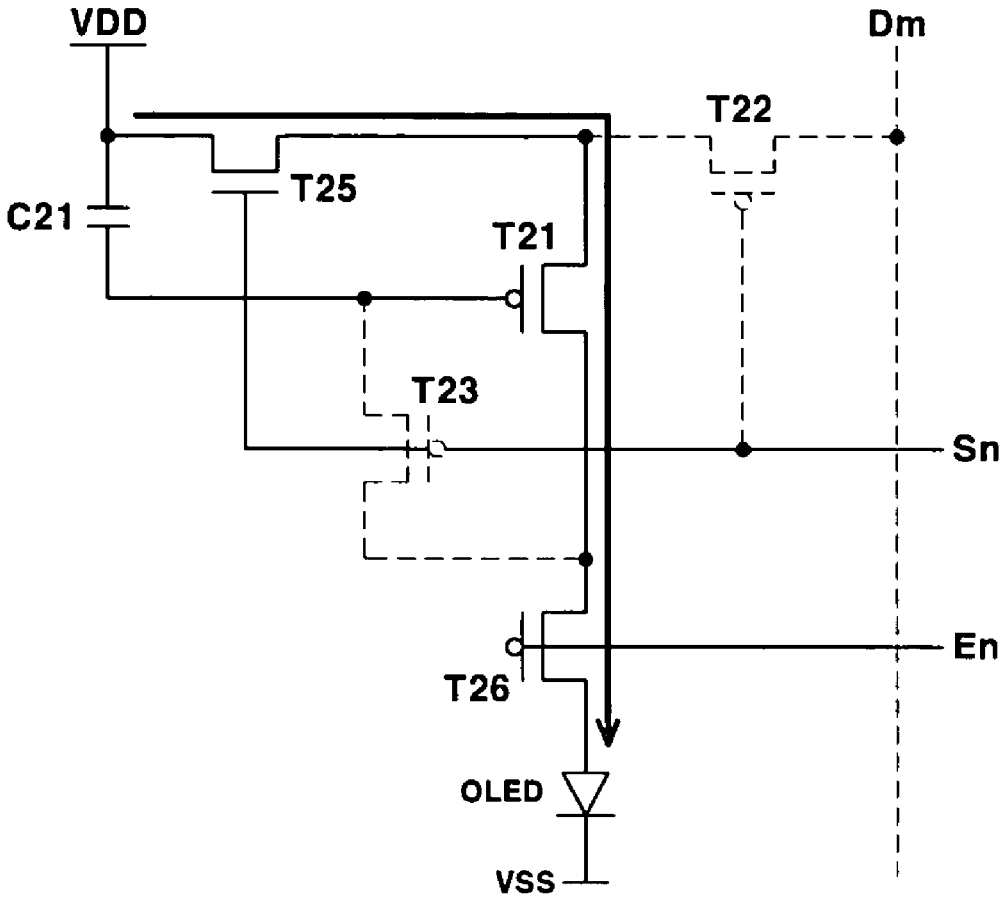

FIG. 9 is a waveform diagram illustrating signals applied to the pixel circuit 111 according to the fourth exemplary embodiment of FIG. 8, and FIGS. 10A, 10B and 10C are diagrams showing a current path formed for each period in FIG. 9.

As shown in FIG. 9, a period D1 is an initialization interval during which the current select signal Sn has a low level and the emit control signal En has a low level. During this period D1, the transistors T22 and T23 are turned on in response to the current select signal Sn and the transistor T26 is turned on in response to the emit control signal En. On the other hand, the n-channel transistor T25 is turned off in response to the current select signal having a low level. During this period D1, the transistors T23 and T26 are turned on, thereby instantaneously forming an initialization current path indicated by a thick line in FIG. 10A. In other words, a voltage stored in the capacitor C21 is initialized by a path of current flowing into the OLED element (OLED) through the transistors T23 and T26, and therefore the gate electrode of the transistor T21 is initialized to a voltage of Vss+|Vth(OLED)|.

A period D2 is a data programming interval during which the current selection Sn has a low level and the emit control signal En has a high level. During this period D2, the transistor T23 is turned on by the select signal Sn having the low level, the driving transistor T21 is diode-coupled, and the switching transistor T22 is turned on. In addition, n-channel transistor T25 is turned off by the current select signal Sn having the low level, and the transistor T26 is turned off by the emit control signal En. Thus, a programming path is formed as indicated by a thick line in FIG. 10B. Accordingly, the data voltage $V_{DATA}$ applied to the corresponding data line is applied to the gate electrode of the driving transistor T21 through the threshold voltage compensation transistor T23.

Since the driving transistor T21 is diode-coupled, a gate voltage $V_{DATA}$−Vth (the subtraction of the threshold voltage Vth of the transistor T21 from the data voltage $V_{DATA}$) is applied to the gate electrode of the transistor T21, and this gate voltage $V_{DATA}$−Vth is stored in the capacitor C21, thereby completing the data programming.

A period D3 is a short interval during which both of the current selection Sn and the emit control signal En have a high level. This period D3 serves to prevent parasitic currents, which are generated while the data voltage is programmed in the period D2, from flowing into the OLED element (OLED). Accordingly, the OLED display can more stably display images.

Next, a period D4 is a light emission interval during which the current select signal Sn has a high level and the emit control signal En has a low level. During this period D4, a light emission path is formed, as indicated by a thick line in FIG. 10C. In other words, the switching transistors T25 and T26 are turned on by the current select signal having the high level and the emit control signal En having the low level, respectively, and the threshold voltage compensation transistor T23 and the switching transistor T22 are turned off by the current select signal Sn having the high level. Accordingly, the current $I_{OLED}$ corresponding to the data voltage applied to the gate electrode of the driving transistor T21 flows into the OLED element (OLED) to thereby emit light.

Thus, according to the fourth exemplary embodiment, during the period D1 during which both of the current select signal Sn and the emit control signal En have the low level, by forming the path of current flowing into the cathode of the OLED element (OLED) through the transistors T23 ands T26, the capacitor C21 can be initialized. Therefore, for period D1, the certain time period td (e.g., 0.05 μs<td<2.5 μs) may be used in the same way as in the second exemplary embodiment shown in FIG. 5.

Figure 11:
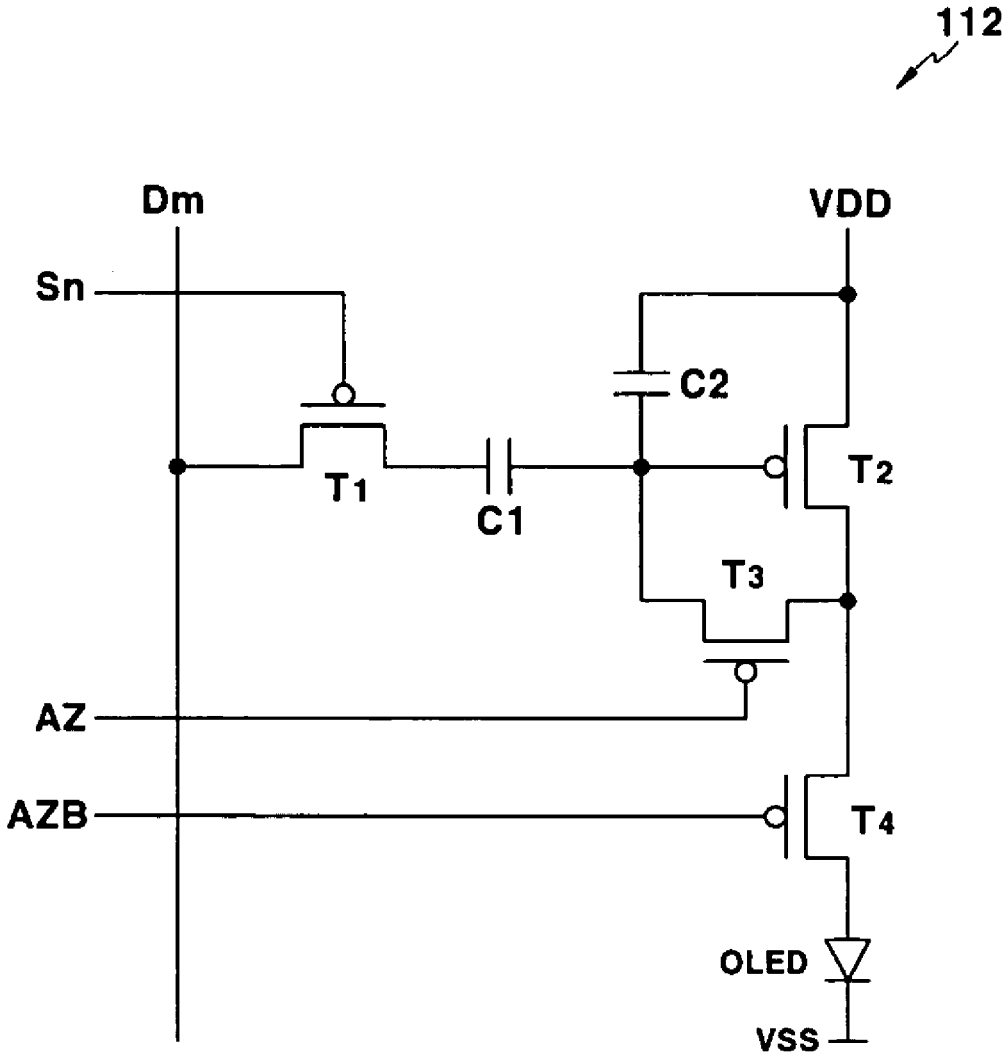
FIG. 11 is an equivalent circuit diagram of a pixel circuit of a light emitting display according to a fifth exemplary embodiment of the present invention.
Figure 12:
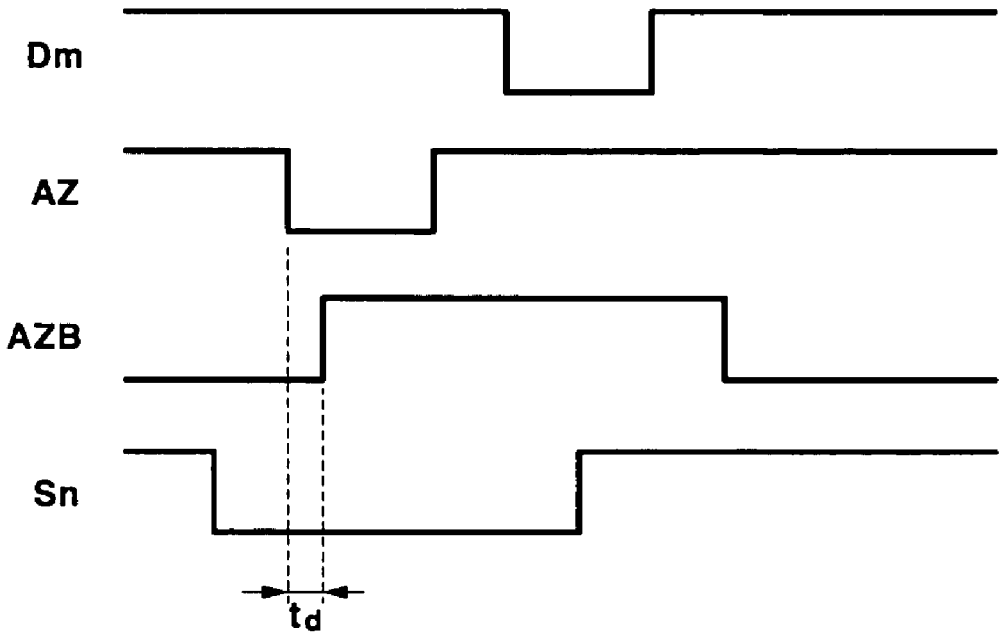
FIG. 12 is a timing diagram of signals applied to the pixel circuit of FIG. 11.

FIG. 11 is an equivalent circuit diagram of a pixel circuit 112 of a light emitting display according to a fifth exemplary embodiment of the present invention, and FIG. 12 is a timing diagram of signals applied to the pixel circuit 112 of FIG. 11.

In the embodiment shown in FIG. 11, the pixel circuit includes four transistors T1, T2, T3 ant T4, and two capacitors C1 and C2.

The transistor T1 has a source electrode coupled to a data line Dm and a gate electrode coupled to a current scan line Sn. The capacitor C1 has one end coupled to a drain electrode of the transistor T1 and the other end coupled to a gate electrode of the transistor T2. The capacitor C2 has one end coupled to an operation voltage VDD and the other end coupled to the gate electrode of the transistor T2. The transistor T2 has a source electrode coupled to the operation voltage VDD. The transistor T3 has a gate electrode coupled to a signal line AZ. The transistor T2 is diode-coupled based on a signal from the signal AZ. The transistor T4 has a gate electrode coupled to a signal line AZB and flows a current from the transistor T2 into an anode of the OLED element (OLED) based on a signal from the signal line AZB.

As shown in FIG. 12, during the time when the select signal Sn has a low level and the transistor T1 is turned on, when the signal AZ has a low level, the transistor T3 is turned on, the transistor T2 is diode-coupled, and accordingly, a voltage corresponding to a threshold voltage of the transistor T2 is stored in the capacitor C2.

Next, when the data signal Dm is applied after the signal AZ goes to a high level, the data signal is transmitted to the one end of the capacitor C1 through the transistor T1, and a gate-source voltage Vgs of the transistor T2 is stored in the capacitor C2 by a coupling between the capacitor C1 and the capacitor C2. When the signal AZB has a low level, the transistor T4 is turned on, and current from the transistor T2 flows into the anode of the OLED element (OLED) by the voltage stored in the capacitor C2. Accordingly, the OLED element (OLED) emits light.

Here, for a certain time period td during which both of the signal AZ and the signal AZB have a low level, the transistors T3 and T4 are concurrently turned on to initialize the gate electrode of the transistor T2, which is coupled to the capacitors C1 and C2. Here, the certain time period td, that is, 0.05 μs<td<2.5 μs, may be used in the same way as in the second exemplary embodiment shown in FIG. 5.

As apparent from the above description, by applying the current select signal Sn having the low level and the current light emission En having the low level concurrently for a certain time period such that the path of current flowing into the cathode of the OLED element (OLED) is formed, the gate electrode of the driving transistor in the pixel circuit can be initialized.

In addition, in the pixel circuit according to exemplary embodiments of the present invention, by initializing the gate electrode of the driving transistor immediately before the data voltage is programmed, the data voltage can be stably programmed for a frame time even when the data has a high level for a previous frame time and the data has a low level for a next frame time.

While this invention has been described in reference to certain exemplary embodiments in connection with the OLED display, the present invention may be applied to other displays requiring other power supplies. Therefore, it is to be understood that the invention is not limited to the disclosed embodiments but, on the contrary, is intended to cover various modifications and equivalent arrangements included within the spirit and scope of the appended claims.

What is claimed is:

1. A light emitting display comprising:

a plurality of scan lines for transmitting a select signal;

a plurality of data lines for transmitting a data signal;

a plurality of pixel circuits, each coupled to at least one of the plurality of scan lines and at least one of the plurality of data lines, at least one of the pixel circuits comprising:

a transistor;

a first capacitor having a first end coupled to a gate electrode of the transistor;

a second capacitor coupled at one end to a first power line and connected at the other end to a second end of the first capacitor;

a first switch coupled between the gate electrode and a first main electrode of the transistor, wherein the first switch is turned on in response to a first level of a first control signal, thereby diode-coupling the transistor;

a light emitting element for emitting light corresponding to a current flowing out of the first main electrode of the transistor; and a second switch for being turned on in response to a second level of a second control signal for transmitting the current flowing out of the first main electrode of the transistor; and a control signal driver configured to provide the first control sianal to the first switch and the second control signal to the second switch, to have the second switch ON during a first period while the first switch is ON, to turn off the second switch after the first period while the first switch remains ON, and to turn on the second switch after the first switch is turned off.

2. The light emitting display of claim 1, wherein the first period is longer than 0.05 μs.

3. The light emitting display of claim 1, wherein the first period is shorter than 2.5 μs.

4. The light emitting display of claim 1, wherein the at least one of the pixel circuits further includes:

a third switch for being turned on in response to a third level of the select signal for transmitting the data signal to the second end of the first capacitor.

5. A light emitting display comprising:

a plurality of scan lines for transmitting a select signal;

a plurality of data lines for transmitting a data signal;

a plurality of pixel circuits, each coupled to at least one of the plurality of scan lines and at least one of the plurality of data lines, at least one of the pixel circuits comprising:

a transistor;

a first capacitor having one end coupled to a gate electrode of the transistor;

a first switch coupled between the gate electrode and a first main electrode of the transistor, wherein the first switch is turned on in response to a first level of a first control signal, thereby diode-coupling the transistor;

a light emitting element for emitting light corresponding to a current flowing out of the first main electrode of the transistor; and a second switch for being turned on in response to a second level of a second control signal for transmitting the current flowing out of the first main electrode of the transistor; and a control signal driver configured to provide the first control signal to the first switch and the second control signal to the second switch, to have the second switch ON during a first period while the first switch is ON to turn off the second switch after the first period while the first switch remains ON, and to turn on the second switch after the first switch is turned off, wherein the at least one of the pixel circuits further includes:

a third switch for being turned on in response to a third level of the select signal for transmitting the data signal to the other end of the first capacitor;

a second capacitor having one end coupled to a first power line and an other end coupled to the other end of the first capacitor; and a fourth switch for being turned on in response to a fourth level of a third control signal to be coupled to the second capacitor in parallel.

6. The light emitting display of claim 5, wherein the first control signal is a previous select signal applied prior to the select signal, and the first level is equal to the third level.

7. The light emitting display of claim 5, wherein the third control signal is equal to the first control signal, and the fourth level is equal to the first level.

8. The light emitting display of claim 7, wherein the second switch is turned on when the first switch, the third switch and the fourth switch are turned off.

9. The light emitting display of claim 7, wherein the select signal having the third level is applied after the second period during which a previous select signal is applied.

10. A light emitting display comprising:

a plurality of scan lines for transmitting a select signal;

a plurality of data lines for transmitting a data signal;

a plurality of pixel circuits, each coupled to at least one of the plurality of scan lines and at least one of the plurality of data lines, at least one of the pixel circuits comprising:

a transistor;

a capacitor having one end coupled to a gate electrode of the transistor;

a first switch coupled between the gate electrode and a first main electrode of the transistor, wherein the first switch is turned on in response to a first level of a first control signal, thereby diode-coupling the transistor;

a light emitting element for emitting light corresponding to a current flowing out of the first main electrode of the transistor; and a second switch for being turned on in response to a second level of a second control signal for transmitting the current flowing out of the first main electrode of the transistor; and a control signal driver configured to provide the first control signal to the first switch and the second control signal to the second switch, to have the second switch ON during a first period while the first switch is ON to turn off the second switch after the first period while the first switch remains ON, and to turn on the second switch after the first switch is turned off, wherein the at least one of the pixel circuits further includes:

a third switch for being turned on in response to a third level of the select signal for transmitting the data signal to a second main electrode of the transistor; and a fourth switch for being turned on in response to a fifth level of a fourth control signal for transmitting the data signal transmitted through the third switch to an other end of the capacitor.

11. The light emitting display of claim 10, wherein the first control signal and the fourth control signal are the select signal.

12. A method for driving a light emitting display including a capacitor having a first electrode coupled to a first power source, a driving transistor having a gate electrode coupled to a second electrode of the capacitor, and a light emitting element for emitting light based on a current applied from the driving transistor, the method comprising:

transmitting the current from the driving transistor to the light emitting element when the driving transistor is in a diode-coupled state;

coupling the light emitting element to the driving transistor; and transmitting the current from the driving transistor to the light emitting element when the first power source is coupled to a source electrode of the driving transistor, wherein the current is transmitted from the driving transistor to the light emitting element when the driving transistor is diode-coupled for a time longer than 0.05 μs.

13. The method of claim 12, wherein the current is transmitted from the driving transistor to the light emitting element when the driving transistor is diode-coupled for a time shorter than 2.5 μS.

14. The method of claim 12, further comprising applying a data voltage to the capacitor before coupling the light emitting element to the driving transistor.

15. The method of claim 12, wherein coupling the light emitting element to the driving transistor further comprising applying a data voltage to the capacitor.

16. A light emitting display comprising:

a plurality of scan lines for transmitting a select signal;

a plurality of data lines for transmitting a data signal;

a plurality of pixel circuits, each coupled to at least one of the plurality of scan lines and at least one of the plurality of data lines, at least one of the pixel circuits comprising:

a transistor having a gate electrode and a first main electrode;

a capacitor having one end coupled to the gate electrode of the transistor;

a first switch coupled between the gate electrode and the first main electrode of the transistor, wherein the first switch is turned on in response to a first level of a first control signal, thereby diode-coupling the transistor;

a light emitting element for emitting light corresponding to a current flowing out of the first main electrode of the transistor; and a second switch for being turned on in response to a second level of a second control signal for transmitting the current flowing out of the first main electrode of the transistor; and a driver coupled to the plurality of scan lines, the driver configured to provide the first control signal and the second control signal to have the second switch ON during a first period while the first switch is ON, to turn off the second switch after the first period while the first switch remains ON, and to turn on the second switch after the first switch is turned off.

17. The light emitting display of claim 16, wherein the first period is longer than 0.05 μs.

18. The light emitting display of claim 16, wherein the first period is shorter than 2.5 μs.

19. The light emitting display of claim 16, wherein the at least one of the pixel circuits further comprises:

a third switch for being turned on in response to a third level of the select signal for transmitting the data signal to the other end of the capacitor; and a second capacitor having a first end coupled to a first power line and a second end coupled to the other end of said capacitor.

* * * * *

UNITED STATES PATENT AND TRADEMARK OFFICE

CERTIFICATE OF CORRECTION

PATENT NO. : 7,408,533 B2
APPLICATION NO. : 11/138745
DATED : August 5, 2008
INVENTOR(S) : Ki-Myeong Eom and Choon-Yul Oh It is certified that error appears in the above-identified patent and that said Letters Patent is hereby corrected as shown below:

In the Claims

| | |
|---|---|
| Column 12, line 6, Claim 1 | Delete "sianal",<br>Insert --signal-- |
| Column 12, line 44, Claim 5 | Delete "ON to",<br>Insert --ON, to-- |
| Column 13, line 27, Claim 10 | Delete "ON to",<br>Insert --ON, to-- |

Signed and Sealed this

Seventeenth Day of February, 2009

JOHN DOLL
*Acting Director of the United States Patent and Trademark Office*